US006646192B1

(12) United States Patent
Marsland et al.

(10) Patent No.: US 6,646,192 B1
(45) Date of Patent: Nov. 11, 2003

(54) COMBINATION DRUMSTICK/BRUSH

(76) Inventors: Russell E. Marsland, Spirit Percussion M9 711 7th Avenue, New Westminster BC (CA), V3M 5S8; Shawn Soucy, 2987 Charles Street, Vancouver, British Columbia (CA), V5K 3B3

( * ) Notice: Subject to any disclaimer, the term of this patent is extended or adjusted under 35 U.S.C. 154(b) by 0 days.

(21) Appl. No.: 10/160,061

(22) Filed: Jun. 4, 2002

(51) Int. Cl.[7] ..... G10D 13/02
(52) U.S. Cl. ..... 84/422.4
(58) Field of Search ..... 84/422.4

(56) References Cited

U.S. PATENT DOCUMENTS

| | | | | | |
|---|---|---|---|---|---|
| 2,485,822 | A | * | 10/1949 | Golrich | 84/422.4 |
| 2,485,823 | A | | 10/1949 | Goldrich | 84/422.4 |
| 2,728,257 | A | * | 12/1955 | Pochobradsky | 84/422.4 |
| 3,420,134 | A | | 1/1969 | Cordes | 84/422.4 |
| 4,028,983 | A | * | 6/1977 | Calato | 84/422.4 |
| 4,114,503 | A | | 9/1978 | Petillo | 84/422.4 |
| D278,634 | S | | 4/1985 | Anderson | D17/22 |
| 4,535,671 | A | | 8/1985 | Stromberg et al. | 84/422.4 |
| D281,785 | S | | 12/1985 | Balter et al. | D17/22 |
| 4,570,527 | A | | 2/1986 | Pruitt | 84/422.4 |
| 4,590,839 | A | | 5/1986 | Liedtke et al. | 84/422.4 |
| 6,002,077 | A | | 12/1999 | Nicholosi | 84/422.4 |
| D436,616 | S | | 1/2001 | Kaiser | D17/22 |

FOREIGN PATENT DOCUMENTS

| | | |
|---|---|---|
| DE | 3902429 | 8/1990 |

* cited by examiner

*Primary Examiner*—Shih-Yung Hsieh
(74) *Attorney, Agent, or Firm*—Richard C. Litman

(57) ABSTRACT

A combination drumstick/brush that can be converted from a conventional drum brush to one with a dowel centered within and running parallel to the brush bristles by extending the dowel from the drum brush handle. In one embodiment the dowel is attached to a push\pull rod having a finger grip extending from the handle for pushing and pulling the dowel into and out of the handle. In another embodiment the dowel is clamped between the bristles by an O-ring and extended and retracted from the handle manually. In another embodiment the drumstick has a bundle of rods at one end, while the opposite end of the handle is shaped like a drumstick. The bundle of rods are constructed of either nylon, wood, bamboo, metal, plastic or a combination thereof.

14 Claims, 7 Drawing Sheets

COMBINATION DRUMSTICK/BRUSH

BACKGROUND OF THE INVENTION

1. Field of the Invention

The present invention relates to musical instruments and, more particularly, to a combination drum brush and drumstick which can be converted from a conventional drum brush to one with a dowel centered within and running parallel to the brush bristles by slidably extending the dowel from the drum brush handle. The dowel is constructed of either nylon, wood, bamboo, metal, plastic or a combination thereof.

2. Description of the Related Art

There are two broad categories of drumsticks—the stick type and the brush type. Typically, the stick type drumstick is constructed of wood and is elongated and cylindrical in shape with a ball-like head formed at one end. The end of the stick with the ball-like head is used to produce a hard and crisp sound when striking a drum. The brush type drumstick, or drum brush, is typically constructed of thin metal wire filaments which are secured to one end of a tubular handle. The wire filaments, or bristles, are pliable and produce a soft, jazzy, swish-like sound when striking a drum.

Stick type drumsticks can be further categorized into one of two subcategories. The first consists of variations of a single elongated stick with a ball-like head formed at one end. Examples from this group include U.S. Des. Pat. No. 436,616 to Kaiser, U.S. Pat. No. 4,114,503 to Petillo, U.S. Des. Pat. No. 278,634 to Anderson, and the German patent DE3902429 to Rau. This type of drumstick is limited in that the type of sound it produces can not be varied, nor can it produce a blended sound, i.e., a sound produced when more than one type of stick simultaneously strikes a drum. Instead it is limited to producing one type of sound—at clear and crisp percussive sound.

The second subcategory of stick type drumsticks consists of those that are actually bundles of sticks. Typically, a drumstick in this subcategory is constructed of a plurality of cylindrically-shaped wooden rods secured to a wooden handle. Examples from this group included U.S. Pat. No. 4,535,671 to Stromberg et al., U.S. Pat. No. 4,570,527 to Pruitt, and U.S. Pat. No. 6,002,077 to Nicolosi. Due to the interaction of the rods when striking a drum, this type of drumstick typically provides a percussive sound that differs from that of a single stick drumstick. Additionally, as taught by the Nicolosi patent, the sound produced by this type of drumstick can be varied slightly by restricting movement among the rods with a slidable sleeve. By sliding the sleeve away from the handle, it increasingly acts to bind the rods together. However, although movement among the rods can be gradually restricted by binding the rods together, movement can not be enhanced because the interstices between the rods are incapable of being increased. Notably, this type of drumstick is not capable of producing a blended sound.

Drum brushes, which make up the second broad category of drumsticks, can also be further categorized into one of two subcategories. The first subcategory consists of traditional drum brushes, which are typically constructed of wire bristles secured to a handle. Examples from this group included U.S. Pat. No. 2,485,823 to Goldrich, and U.S. Pat. No. 3,420,134 to Cordes. Like the single stick type drumstick, the traditional drum brush is limited in that the sound it produces can not be varied and it can not produce a blended sound.

The second subcategory of drum brushes consists of those designed to produce a blended sound by allowing more than one material to simultaneously strike a drum. Examples of this group include U.S. Des. Pat. No. 281,785 to Balter et al. and U.S. Pat. No. 4,590,839 to Liedtke et al. The design patent to Balter shows what appears to be a single stick type of drumstick with bristles secured to the stick in a manner such that the bristles partially, surround the ball-like head of the stick. However, although this may allow for a blended sound it does not allow for variation of sound. Similarly, the patent to Liedtke discloses a drum brush on which pellets are attached to some of the bristles. The pellets are attached away from the ends of the bristles thereby allowing the user to strike a drum with only the bristles or with a combination of the bristles and pellets. However, to vary the sound, the angle at which the brush strikes the drum must be changed.

Thus, none of the above inventions and patents, taken either singly or in combination, is capable of producing a variation of blended sounds without requiring the user to change the manner in which the drumstick or drum brush is held or used. Thus a combination drumstick/brush solving the aforementioned problems is desired.

SUMMARY OF THE INVENTION

The present invention is a combination drum brush and drumstick which can be converted from a conventional drum brush to one with a dowel centered within and running parallel to the brush bristles by slidably extending the dowel from the drum brush handle. The dowel is constructed of either nylon, wood, bamboo, metal, plastic or a combination thereof.

Accordingly, it is a principal object of the invention to allow a user to produce more than one percussive sound at the same time.

It is another principal object of the invention to allow a user to vary the type of sound that is produced without having to, change the manner in which the drumstick or drum brush is held.

It is a further principal of the invention to allow a user to transition from a traditional drum brush to a combination of a drum brush and a drumstick without having to put one stick down to pick up another.

Still another object of the invention is to employ a retractable rod in order to vary the type of sound produced by a combination drumstick/brush.

Additionally, it is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

DETAILED DESCRIPTION OF THE PREFERRED EMBODIMENTS

Figure 1:
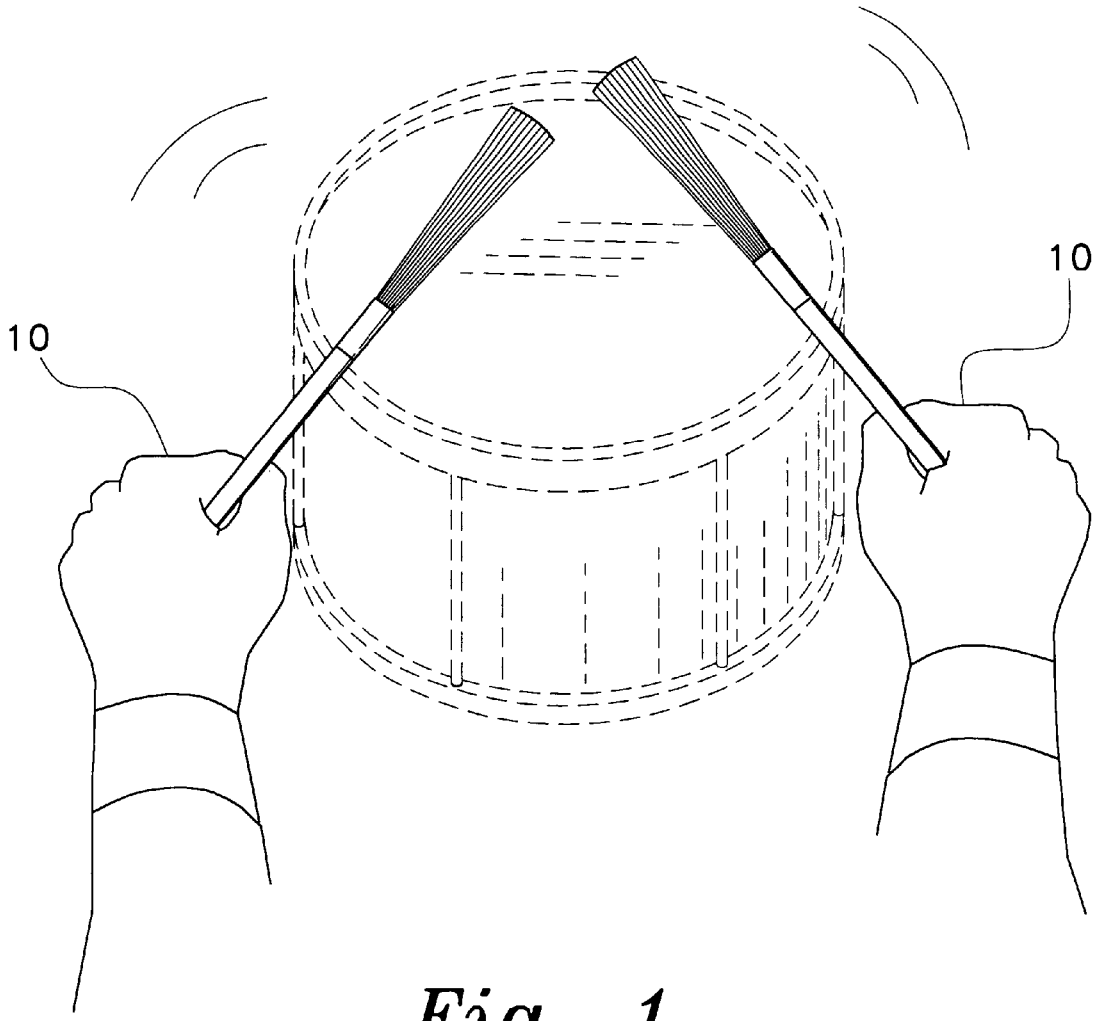
FIG. 1 is an environmental, perspective view of a combination drumstick/brush according to the present invention.

FIG. 1 of the drawings presents an environmental view of the combination drumstick/brush 10 of the present invention. It will be appreciated from the view that the invention is held and maneuvered in the same manner as a traditional drum brush or drumstick.

Figure 2:
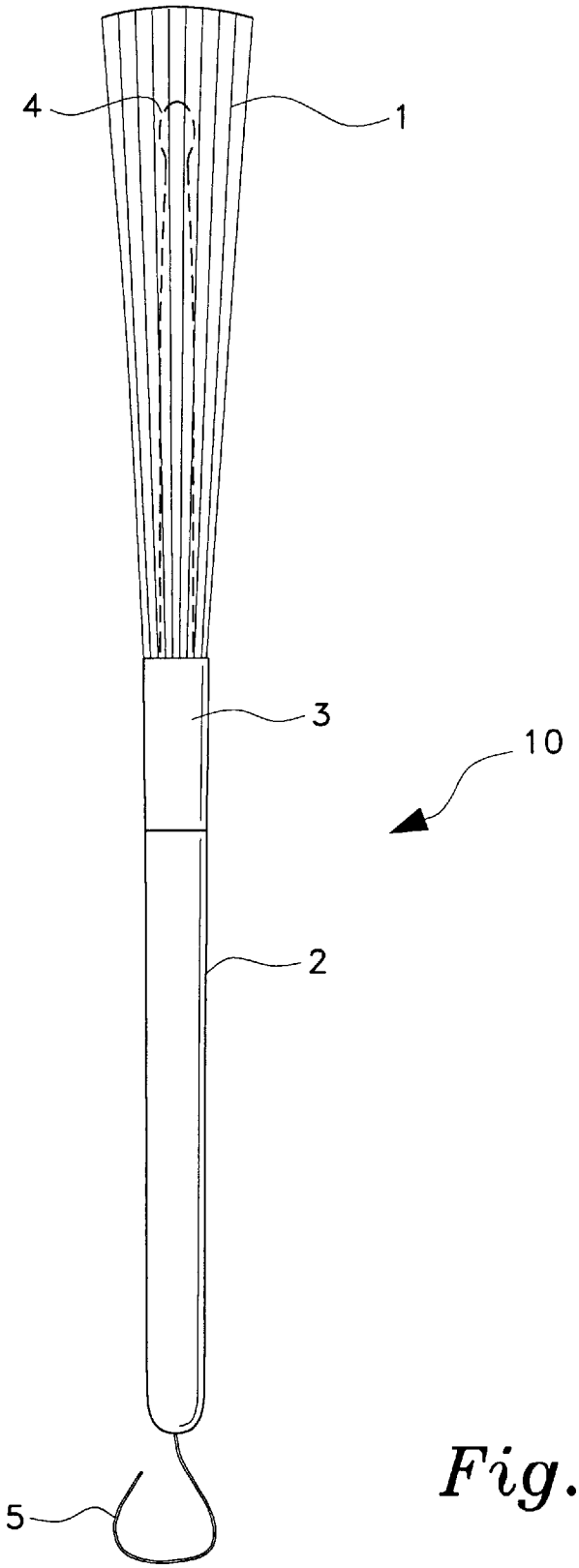
FIG. 2 is an elevational view of the preferred embodiment of a combination drumstick/brush according to the present invention.
Figure 3:
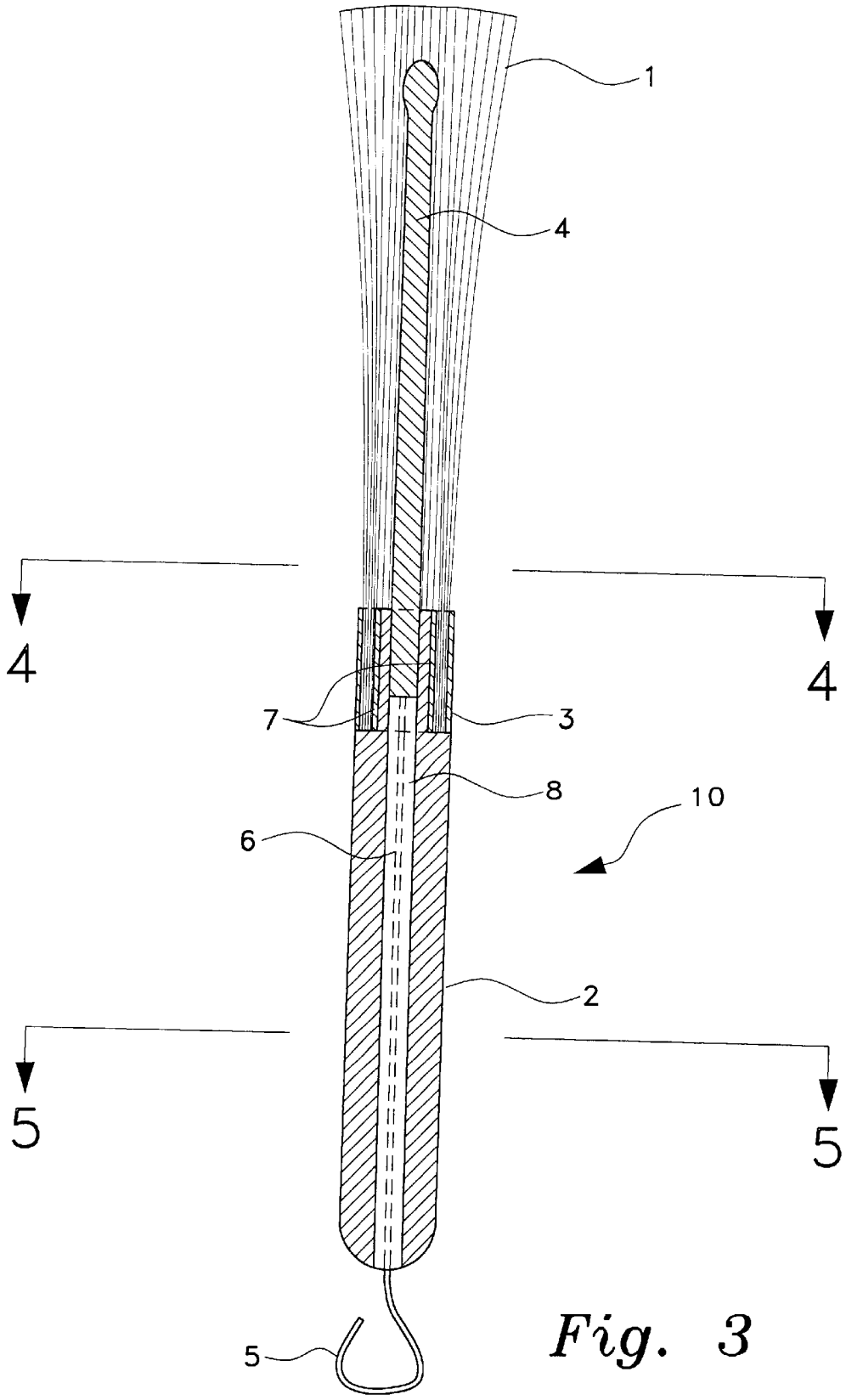
FIG. 3 is a longitudinal cross-section view of the combination drumstick/brush according to FIG. 2.

FIG. 2 of the drawings presents an elevated view of the preferred embodiment of the combination drumstick/brush 10 and depicts a plurality of bristles 1 attached to one end of a hollowed handle 2 by means of an outer aluminum sleeve 3 and an inner plastic sleeve (shown in FIG. 3). A retractable dowel or rod 4, shown in phantom, extends from the same end of the handle 2 as bristles 1. The retractable rod 4 runs parallel to and is surrounded by the bristles 1. The finger grip portion 5 of a push/pull rod protrudes from the end of the handle 2 that is opposite the bristles 1.

FIG. 3 of the drawings presents a longitudinal cross-section view of the preferred embodiment of the combination drumstick/brush 10 and depicts both the plastic inner sleeve 7 and the outer sleeve 3 which together secure the bristles 1 to the handle 2. The retractable rod 4 is attached to a push/pull rod 6. When the finger grip portion 5 of the push/pull rod 6 is pulled away from the device, the push/pull rod 6 pulls the retractable rod 4 into a cylindrical cavity 8 within the handle 2.

Figure 4:
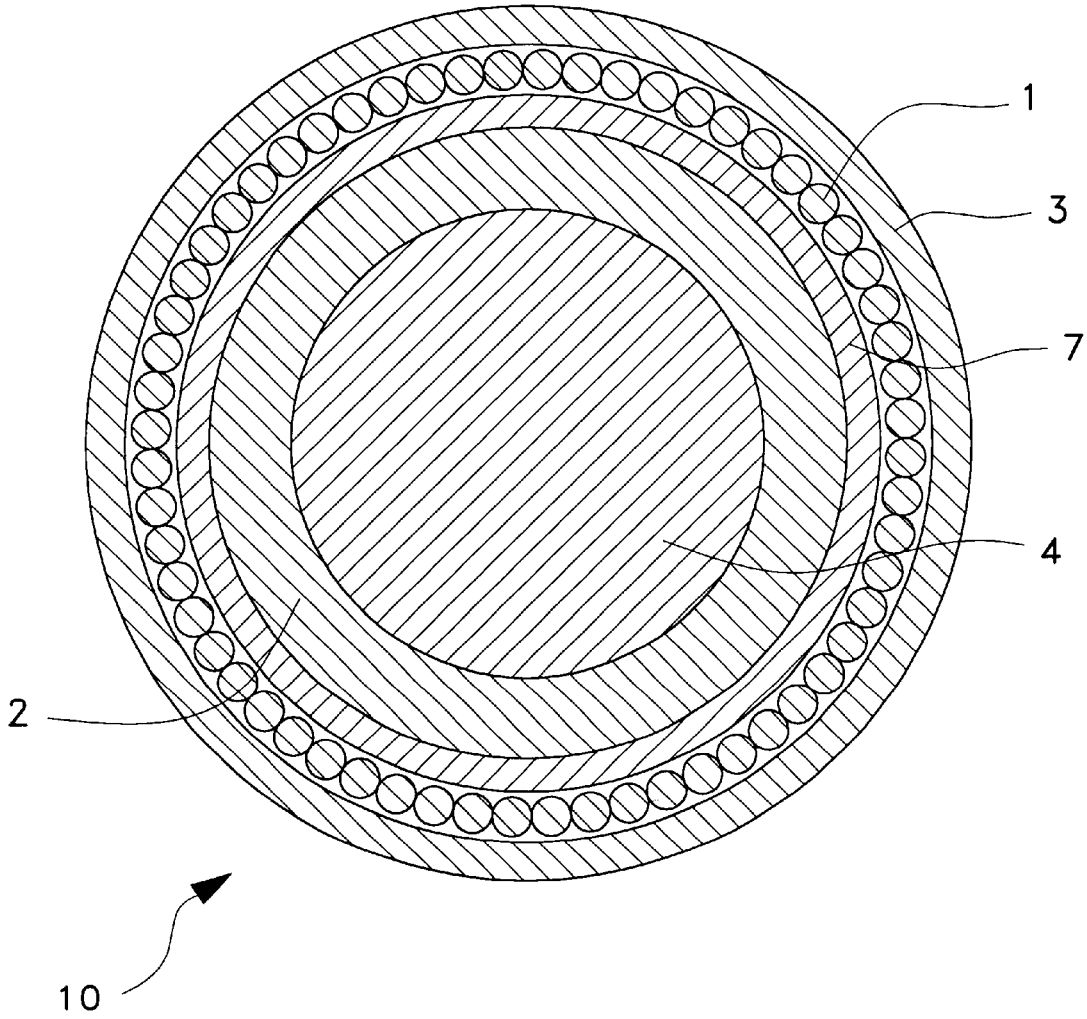
FIG. 4 is a section view along the lines 4—4 of FIG. 3.

FIG. 4 of the drawings presents an axial cross-section view of the bristled portion of the preferred embodiment of the combination drumstick/brush 10 and depicts that the bristles 1 are secured to the handle 2 by the inner sleeve 7 and the outer sleeve 3, and that the retractable rod 4 is centered within the bristles 1.

Figure 5:
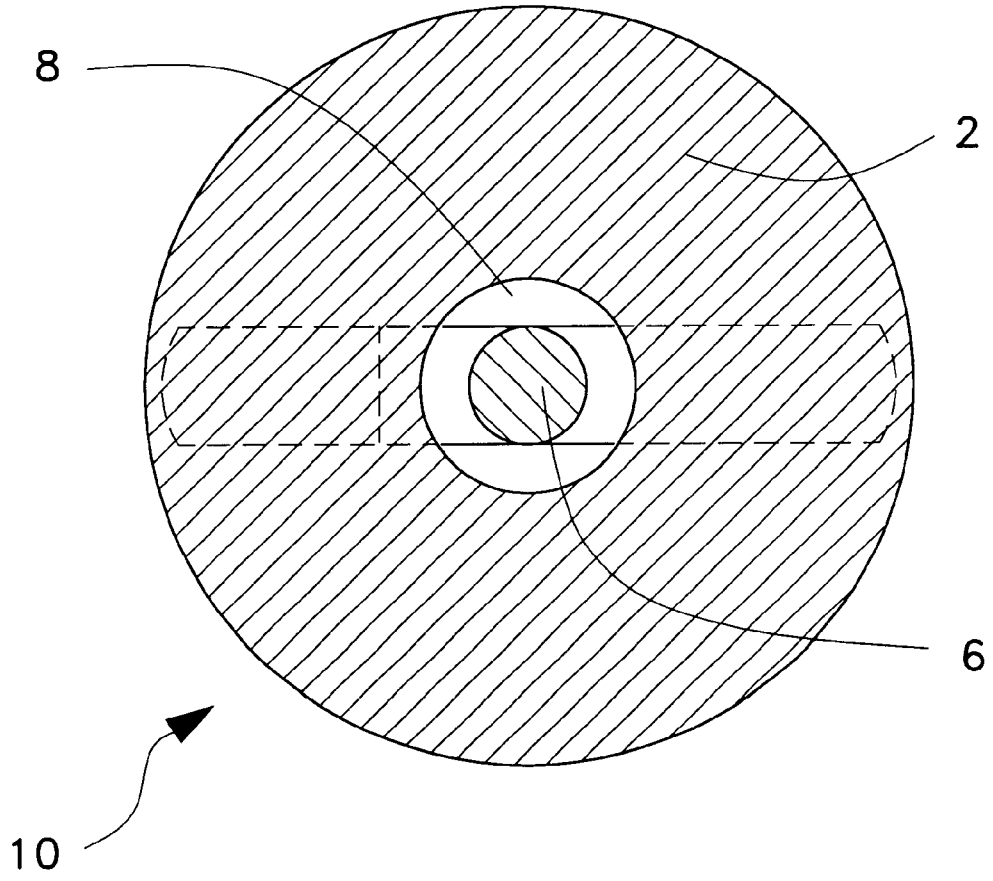
FIG. 5 is a section view along the lines 5—5 of FIG. 3.

FIG. 5 of the drawings presents a axial cross-section view of the handle 2 portion of the combination drumstick/brush 10 and depicts the push/pull rod 6 within the cylindrical cavity 8, both of which are within the handle 2. In the embodiment shown in FIGS. 1–5, the retractable rod 4 may be made from wood, bamboo, or nylon or other lightweight plastic. Preferably, the rod 4 is made from nylon. The outer sleeve 3 is preferably made from aluminum. The bristles are constructed from metal, wood, plastic, and mixtures thereof.

Figure 6:
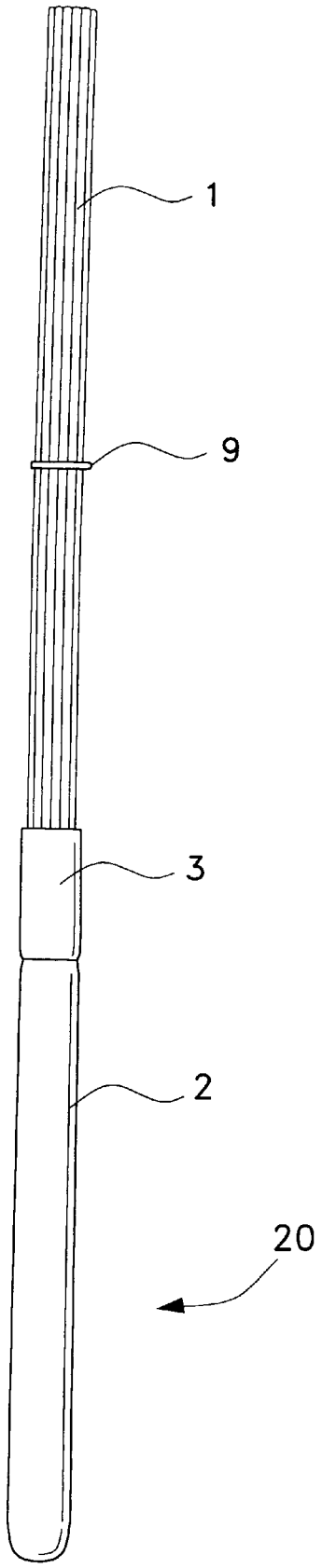
FIG. 6 is an elevational view of an alternative embodiment of a combination drumstick/brush according to the present invention.

FIG. 6 illustrates an alternative embodiment of the combination drumstick/brush, designated generally as 20, that differs from the preferred embodiment in that the bristles 1 are bound together by a slidable rubber O-ring 9 and that a push/pull rod is not attached to the retractable rod (not shown). In this embodiment, the retractable rod is extended or retracted by, spreading the bristles 1 and manipulating the rod with one's fingers. The retractable rod may be made from bamboo, hardwood, metal, nylon or other lightweight plastic, or a combination thereof.

Figure 7:
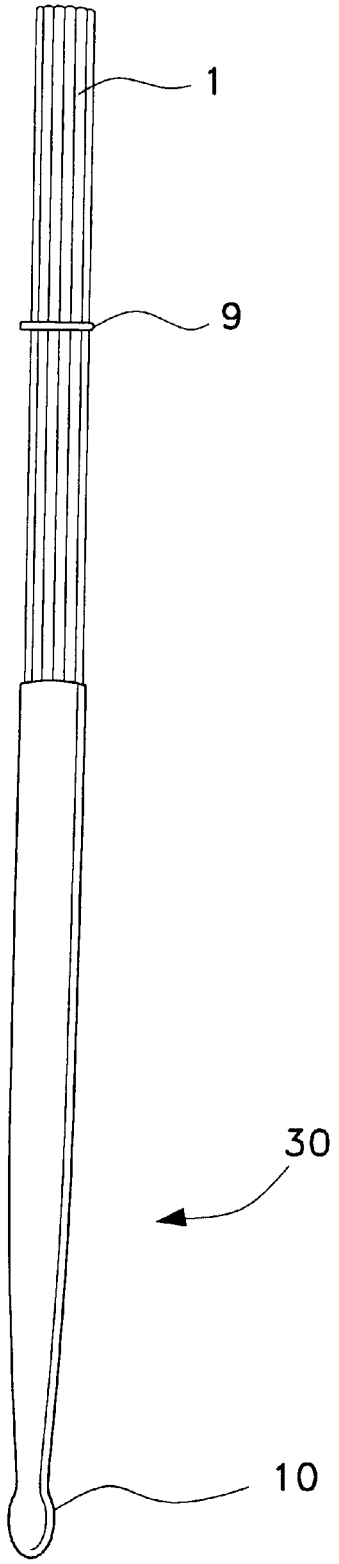
FIG. 7 is an elevational view of a second alternative embodiment of a combination drumstick/brush according to the present invention.

FIG. 7 illustrates a second alternative embodiment of the combination drumstick/brush, designated generally as 30, which only differs from the combination drumstick/brush 20 in that one end of the handle 2 is shaped to form a ball-like head 10 so that either end of the device is suitable for striking a drum.

It is to be understood that the present invention is not limited to the embodiments described above, but encompasses any and all embodiments within the scope of the following claims.

We claim:

1. A combination drumstick/brush comprising:

(a) a handle having a first end and a second end, said handle being hollow;

(b) a plurality of bristles attached to the first end of said handle and defining a brush; and (c) a retractable rod slidable between a retracted position in which said rod is disposed substantially within said handle, and an extended position in which said rod is disposed within the brush defined by said plurality of bristles;

wherein the bristles are constructed of a material from the group consisting of metal, wood, plastic, and mixtures thereof.

2. The combination drumstick/brush according to claim 1, wherein the retractable rod, when in an extended position, runs parallel to and is surrounded by the bristles.

3. The combination drumstick/brush according to claim 1, further comprising a push/pull rod attached to said retractable rod and wherein said push/pull rod extends out of the end of the handle, the push/pull rod being slidably disposed in said hollow handle and having a finger grip portion extending from the second end of said handle.

4. The combination drumstick/brush according to claim 1, wherein the bristles are constructed of metal.

5. The combination drumstick/brush according to claim 1, wherein the bristles are constructed of wire.

6. The combination drumstick/brush according to claim 1, wherein the bristles are constructed of wood.

7. The combination drumstick/brush according to claim 1, further comprising an O-ring disposed about said bristles.

8. The combination drumstick/brush according to claim 1, wherein the bristles are constructed of bamboo.

9. The combination drumstick/brush according to claim 1, wherein the bristles are constructed of plastic.

10. The combination drumstick/brush according to claim 1, wherein the handle is shaped to form a ball-like head at the second end of said handle.

11. The combination drumstick/brush according to claim 1, wherein said rod is made from nylon.

12. The combination drumstick/brush according to claim 1, wherein said rod is made from wood.

13. The combination drumstick/brush according to claim 1, wherein said rod is made from bamboo.

14. The combination drumstick/brush according to claim 1, wherein said rod is made a lightweight plastic material.

* * * * *